US010546520B2

(12) United States Patent
Noh et al.

(10) Patent No.: US 10,546,520 B2
(45) Date of Patent: Jan. 28, 2020

(54) GATE DRIVER AND FLAT PANEL DISPLAY DEVICE INCLUDING THE SAME

(71) Applicant: LG Display Co., Ltd., Seoul (KR)

(72) Inventors: Seok Noh, Chungcheongnam-do (KR); In-Hyo Han, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/044,260

(22) Filed: Jul. 24, 2018

(65) Prior Publication Data

US 2019/0043405 A1 Feb. 7, 2019

(30) Foreign Application Priority Data

Aug. 4, 2017 (KR) ..... 10-2017-0098872

(51) Int. Cl.
*G09G 3/20* (2006.01)
*G09G 3/36* (2006.01)

(52) U.S. Cl.
CPC ..... *G09G 3/20* (2013.01); *G09G 3/3674* (2013.01); *G09G 2300/0408* (2013.01); *G09G 2300/0426* (2013.01); *G09G 2300/0871* (2013.01); *G09G 2310/0218* (2013.01); *G09G 2310/0291* (2013.01); *G09G 2310/08* (2013.01); *G09G 2320/0233* (2013.01)

(58) Field of Classification Search
CPC ... G09G 2300/0408; G09G 2300/0426; G09G 2300/0871; G09G 2310/0218; G09G 2310/0291; G09G 2310/08; G09G 2320/0233; G09G 3/20; G09G 3/3674; G09G 3/2092; G09G 3/3225; G09G 3/3677; G11C 19/28; G11C 19/287
See application file for complete search history.

(56) References Cited

U.S. PATENT DOCUMENTS 9,030,399 B2 5/2015 Tseng et al.
2013/0033468 A1 2/2013 Takahashi
(Continued)

FOREIGN PATENT DOCUMENTS

JP 2013-174876 A 9/2013
WO WO 2012/008186 A1 1/2012

OTHER PUBLICATIONS

European Patent Office, Extended European Search Report and Written Opinion, EP Patent Application No. 18181124.1, dated Dec. 19, 2018, 12 pages.
(Continued)

*Primary Examiner* — Richard J Hong
(74) *Attorney, Agent, or Firm* — Fenwick & West LLP

(57) ABSTRACT

Disclosed herein are a gate driver including at least two output buffers to drive at least two gate lines and capable of reducing an output deviation of each output buffer, and a flat panel display device including the same. The gate driver includes a plurality of gate-in-panels (GIPs) for sequentially supplying scan signals to a plurality of gate lines. Each GIP includes one carry signal output unit and at least two scan signal output units to drive at least two gate lines, and the carry signal output unit includes a pull-up transistor controlled by a voltage of a first node, a pull-down transistor controlled by a voltage of a second node, and a boosting capacitor formed between gate and source electrodes of the pull-up transistor.

10 Claims, 10 Drawing Sheets

(56) References Cited

U.S. PATENT DOCUMENTS

| | | | | |
|---|---|---|---|---|
| 2013/0100007 | A1 | 4/2013 | Yamamoto et al. | |
| 2013/0222357 | A1 | 8/2013 | Tseng et al. | |
| 2015/0009113 | A1* | 1/2015 | Zeng | G09G 3/3677 345/100 |
| 2015/0077319 | A1 | 3/2015 | Yao et al. | |
| 2016/0012764 | A1* | 1/2016 | Xu | G11C 19/28 345/204 |
| 2016/0189677 | A1* | 6/2016 | Cao | G11C 19/287 345/691 |
| 2016/0240129 | A1* | 8/2016 | Kim | G09G 3/2092 |
| 2016/0247446 | A1* | 8/2016 | Cao | G09G 3/3225 |
| 2016/0351159 | A1* | 12/2016 | Yang | G09G 3/20 |
| 2016/0351160 | A1* | 12/2016 | In | G09G 3/3225 |
| 2016/0372078 | A1* | 12/2016 | Song | G09G 3/20 |
| 2017/0365204 | A1* | 12/2017 | Choi | G09G 3/2092 |

OTHER PUBLICATIONS

Japan Patent Office, Notice of Reasons for Rejection, JP Patent Application No. 2018-137304, dated Jun. 18, 2019, six pages.

* cited by examiner

GATE DRIVER AND FLAT PANEL DISPLAY DEVICE INCLUDING THE SAME

CROSS-REFERENCE TO RELATED APPLICATIONS

This application claims the benefit of Republic of Korea Patent Application No. 10-2017-0098872, filed on Aug. 4, 2017, which is hereby incorporated by reference in its entirety.

BACKGROUND DISCLOSURE

Field of Disclosure

The present disclosure relates to a gate driver of a display device and, more particularly, to a gate driver for outputting a plurality of scan pulses in one gate-in-panel (GIP) and a flat panel display device including the same.

Discussion of the Related Art

With development of information-oriented society and development of various portable electronic apparatuses such as mobile communication terminals and laptops, demand for flat panel display devices has gradually increased.

As a flat panel display device, a liquid crystal display (LCD) device using liquid crystal and an organic light emitting diode (OLED) display device using an OLED are used.

Such a flat panel display device includes a display panel including a plurality of gate lines and a plurality of data lines to display an image, and a driver for driving the display panel.

The driver includes a gate driver for driving the plurality of gate lines, a data driver for driving the plurality of data lines, and a timing controller for supplying image data and various control signals to the gate driver and the data driver.

The gate driver may be simultaneously formed in a non-active area of the display panel in a process of forming the plurality of gate lines and the plurality of data lines of the display panel and pixels.

That is, a gate-in-panel (hereinafter referred to as GIP) method of integrating the gate driver on the display panel is applied. In addition, GIPs are configured to correspond one-to-one to the plurality of gate lines.

However, with high resolution and narrow bezel of the flat panel display device, one GIP needs to drive two or more gate lines.

SUMMARY

Accordingly, the present disclosure is directed to a gate driver and a flat panel display device including the same that substantially obviate one or more problems due to limitations and disadvantages of the related art.

An object of the present disclosure is to provide a gate driver including at least two output buffers to drive at least two gate lines and capable of reducing an output deviation of each output buffer, and a flat panel display device including the same.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a gate driver includes a plurality of gate-in-panels (GIPs) for sequentially supplying scan signals to a plurality of gate lines. Each GIP includes one carry signal output unit and at least two scan signal output units to drive at least two gate lines, and the carry signal output unit includes a pull-up transistor controlled by a voltage of a first node, a pull-down transistor controlled by a voltage of a second node, and a boosting capacitor formed between gate and source electrodes of the pull-up transistor.

The at least two scan signal output units may include first and second scan signal output units to drive two gate lines, one of a plurality of scan pulse output clock signals may be applied to each of the at least two scan signal output units, one of a plurality of carry pulse output clock signals may be applied to the carry signal output unit, the plurality of carry pulse output clock signals may be shifted by a predetermined period, adjacent scan pulse output clock signals overlap each other during a predetermined period, and each carry pulse output clock signal may have a longer high period than a high period of two adjacent scan pulse output clock signals, and adjacent carry pulse output clock signals may overlap each other during a period longer than one horizontal period.

Each scan pulse output clock signal may have a high period during two horizontal periods and adjacent scan pulse output clock signals may overlap each other during one horizontal period, and each carry pulse output clock signal may have a high period during 3.5 horizontal periods and adjacent carry pulse output clock signals may overlap each other during 1.5 horizontal periods.

The at least two scan signal output units may include first to fourth scan signal output units to drive four gate lines, one of a plurality of scan pulse output clock signals may be applied to each of the first to fourth scan signal output units, one of a plurality of carry pulse output clock signals may be applied to the carry signal output unit, the plurality of carry pulse output clock signals may be shifted by a predetermined period, adjacent scan pulse output clock signals overlap each other during a predetermined period, and each carry pulse output clock signal may have a longer high period than a high period of four adjacent scan pulse output clock signals, and adjacent carry pulse output clock signals may overlap each other during a period longer than one horizontal period.

Each scan pulse output clock signal may have a high period during two horizontal periods and adjacent scan pulse output clock signals may overlap each other during one horizontal period. Each carry pulse output clock signal may have a high period during six horizontal periods and adjacent carry pulse output clock signals may overlap each other during two horizontal periods.

According to another aspect of the present disclosure, a flat panel display device includes a display panel including a plurality of gate lines and a plurality of data lines and a plurality of subpixels formed in a matrix to supply data voltages to the plurality of data lines in response to scan pulses supplied to the plurality of gate lines to display an image, a gate driver for sequentially supplying the scan pulses to the plurality of gate lines, a data driver for supplying the data voltages to the plurality of data lines, and a timing controller for aligning image data received from the outside according to a size and resolution of the display panel to supply the image data to the data driver and respectively supplying a plurality of gate control signals and a plurality of data control signals to the gate driver and the data driver using signals received from the outside. The gate driver includes a plurality of gate-in-panels (GIPs) for sequentially supplying scan signals to the plurality of gate lines, each GIP comprises one carry signal output unit and at least two scan signal output units to drive at least two gate lines, and the carry signal output unit includes a pull-up transistor controlled by a voltage of a first node, a pull-down transistor controlled by a voltage of a second node, and a boosting capacitor formed between gate and source electrodes of the pull-up transistor.

It is to be understood that both the foregoing general description and the following detailed description of the present disclosure are exemplary and explanatory and are intended to provide further explanation of the disclosure as claimed.

BRIEF DESCRIPTION

The accompanying drawings, which are included to provide a further understanding of the disclosure and are incorporated in and constitute a part of this application, illustrate embodiment(s) of the disclosure and together with the description serve to explain the principle of the disclosure. In the drawings.

Figure 11A:
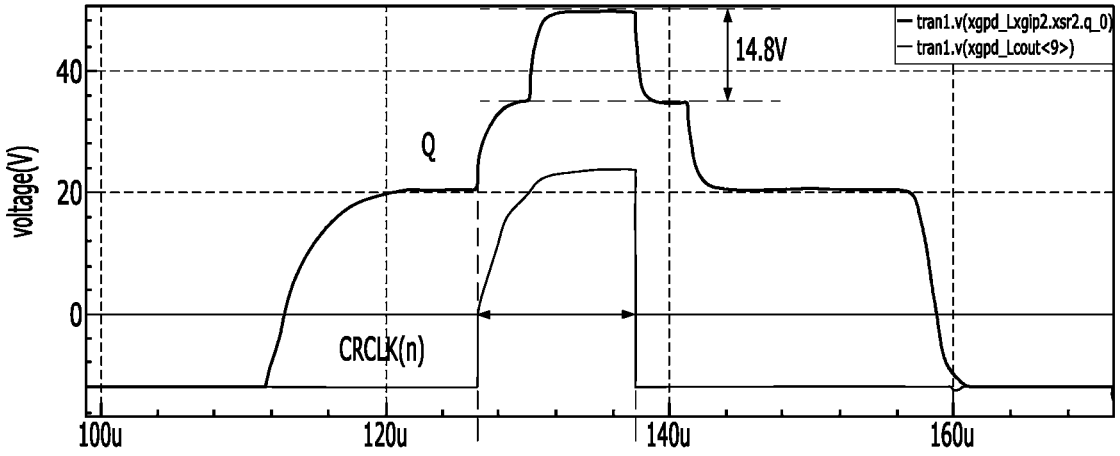
Figure 11B:
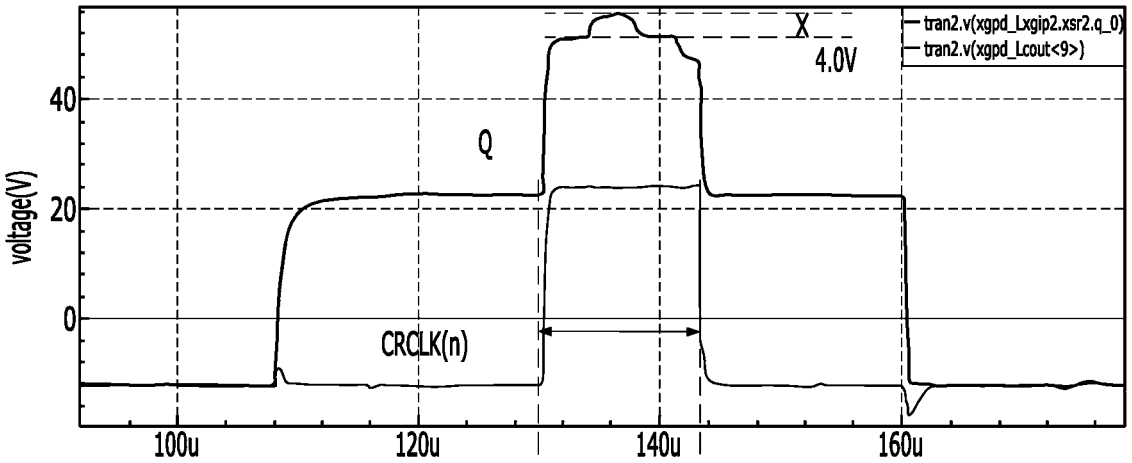
Figure 12A:
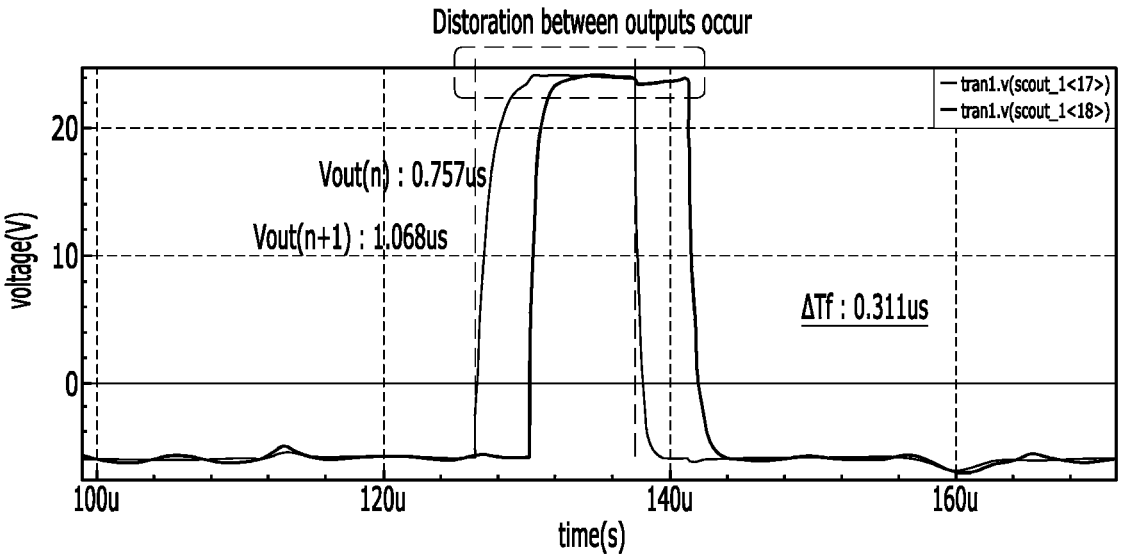
Figure 12B:
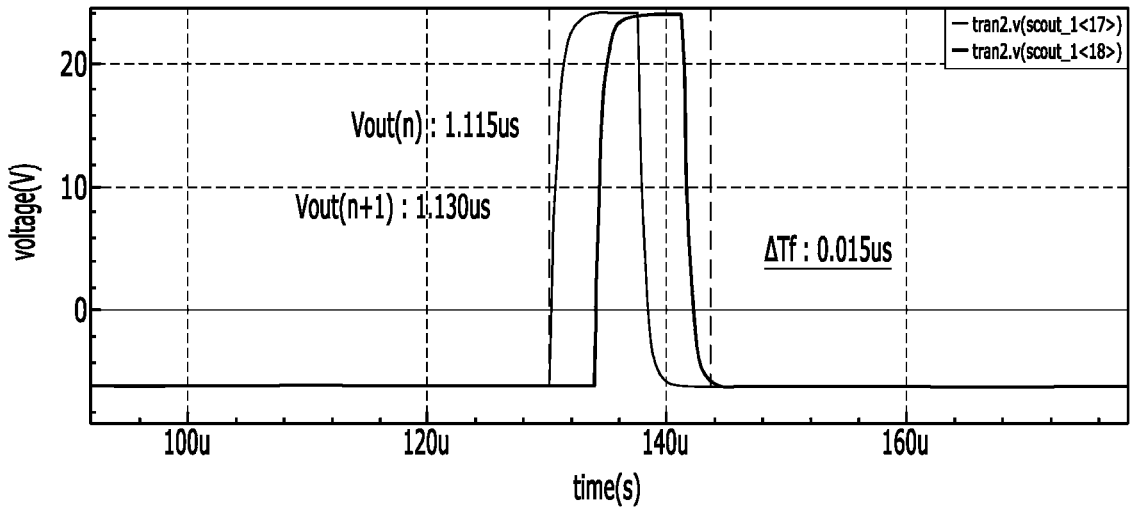

FIG. 11A is a waveform diagram of the voltage of a first node Q and the carry signal output clock signal of the gate driver according to the first embodiment of the present disclosure and FIG. 11B is a waveform of the voltage of the first node Q and the carry signal output clock signal of a gate driver according to the second and third embodiments of the present disclosure; and FIG. 12A is an output waveform diagram of scan signals of the gate driver according to the first embodiment of the present disclosure, and FIG. 12B is an output waveform diagram of scan signals of the gate driver according to the second and third embodiments of the present disclosure.

DETAILED DESCRIPTION OF THE DISCLOSURE

The gate driver and the flat panel display device including the same according to the present disclosure having the above-described features will be described in greater detail with reference to the accompanying drawings.

Figure 1:
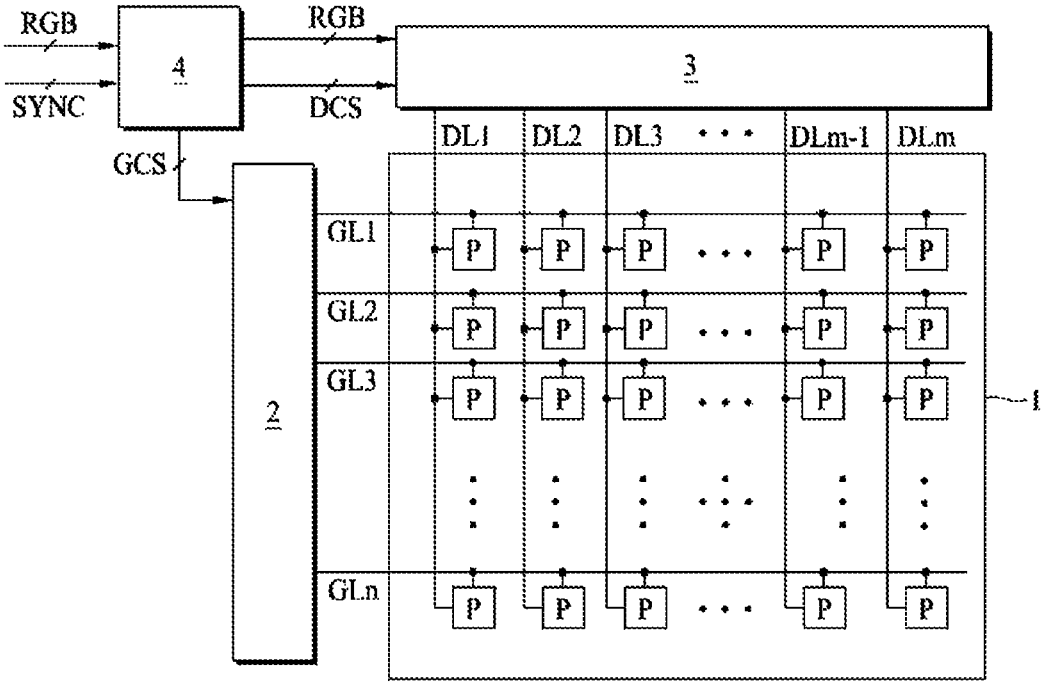
FIG. 1 is a diagram schematically showing a flat panel display device according to the present disclosure.

FIG. 1 is a diagram schematically showing a flat panel display device according to the present disclosure.

As shown in FIG. 1, the flat panel display device according to the present disclosure includes a display panel 1, a gate driver 2, a data driver 3 and a timing controller 4.

On the display panel 1, a plurality of gate lines GL1~GLn and a plurality of data lines DL1~DLm are disposed and a plurality of subpixels P are arranged at intersections between the plurality of gate lines GL1~GLn and the plurality of data lines DL1~DLm in a matrix. The plurality of subpixels P display an image according to image signals (data voltages) received from the plurality of data lines DL1~DLm in response to scan pulses received from the gate lines GL1~GLn.

The gate driver 2 is a gate-in-panel (GIP) type gate driver and is disposed in the non-active area of the display panel 1.

The gate driver 2 includes a gate shift register for sequentially supplying the scan pulse (gate driving signal) Vgout to each gate line GL1~GLn according to a plurality of gate control signals GCS received from the timing controller 4.

The plurality of gate control signals GCS includes a plurality of clock signals having different phases, a gate start signal VST indicating driving start of the gate driver 2, a gate high voltage VGH and a gate low voltage VGL.

The data driver 3 converts digital image data RGB received from the timing controller 4 into an analog data voltage using a reference gamma voltage and supplies the converted analog data voltage to the plurality of data lines DL1~DLm. The data driver 3 is controlled according to a plurality of data control signals DCS received from the timing controller 4.

The timing controller 4 aligns the image data RGB received from the outside according to the size and resolution of the display panel 1 and supplies the image data to the data driver 3. In addition, the timing controller 4 generates a plurality of gate control signals GCS and a plurality of data control signals DCS using signals received from the outside, such as a dot clock, a data enable signal, a horizontal synchronization signal and a vertical synchronization signal and respectively supplies the gate control signals and the data control signals to the gate driver 2 and the data driver 3.

The gate driver 2 includes a plurality of stages (GIPs) in order to sequentially supply the scan pulse (gate driving signal) SP(n) to each of the plurality of gate lines GL1~GLn.

However, when the plurality of GIPs are connected to correspond one-to-one to the plurality of gate lines, recent design requirements such as high resolution and narrow bezel are not satisfied.

Accordingly, one of the plurality of GIPs according to the present disclosure includes one carry signal output unit and at least two scan signal output units such that one GIP drives at least two gate lines.

Figure 2:
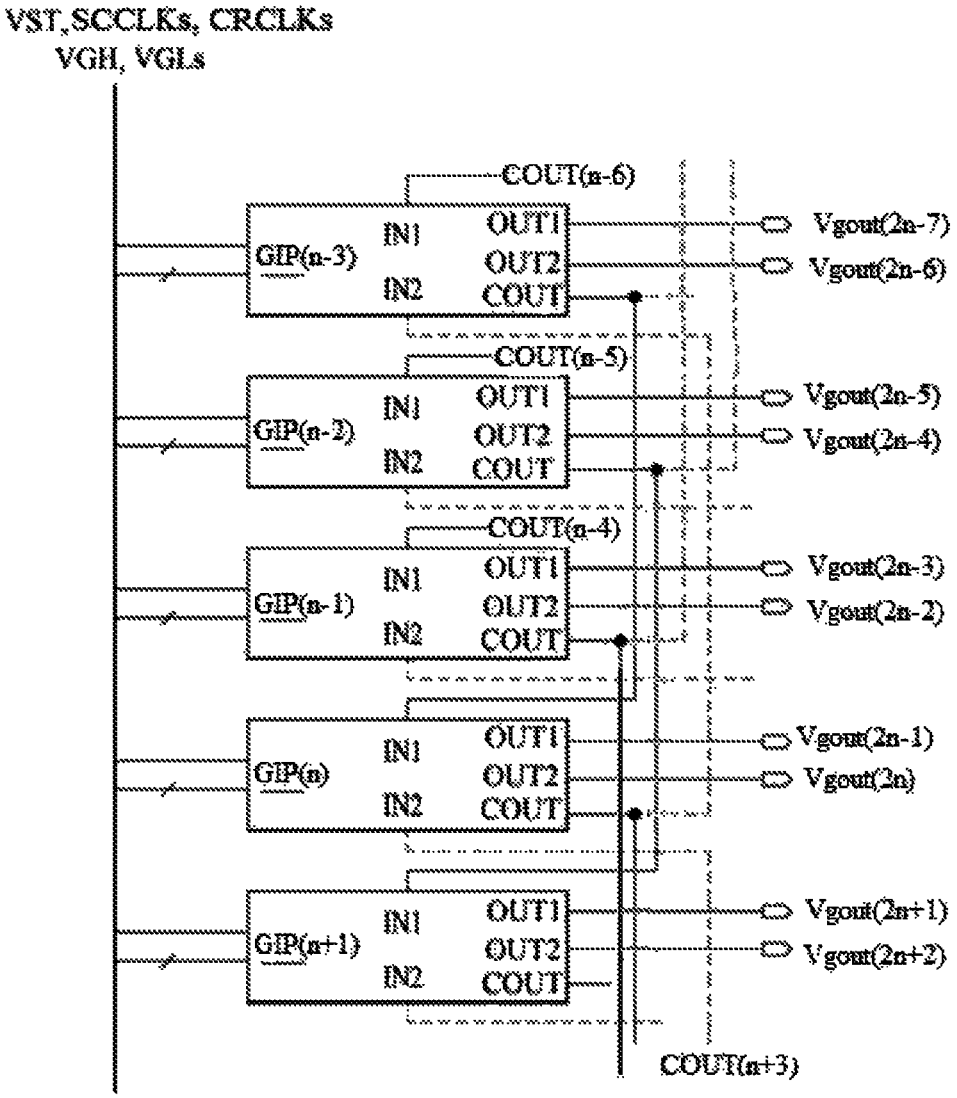
FIG. 2 is a block diagram showing the configuration of a gate driver according to the present disclosure.
Figure 3:
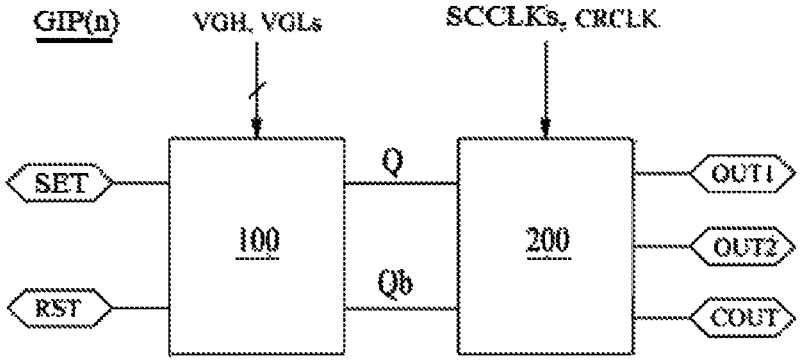
FIG. 3 is a block diagram showing the configuration of a GIP of FIG. 2 according to the present disclosure.

FIG. 2 is a block diagram showing the configuration of a gate driver according to the present disclosure, and FIG. 3 is a block diagram showing the configuration of a GIP of FIG. 2 according to the present disclosure.

As shown in FIG. 2, the gate driver 2 according to the present disclosure includes a plurality of GIPs connected in cascade, and one GIP includes an output unit connected to two gate lines GL to sequentially generate two scan signals Vgout(n) and Vgout(n+1) and a carry signal COUT(n) according to clock signals SCCLKs and CRCLKs received from the timing controller 4.

Specifically, a plurality of clock signals SCCLKs and CRCLKs, a gate high voltage VGH, a plurality of gate low voltages VGLs and a gate start pulse VST received from the timing controller 4 are applied to the gate driver 2.

The plurality of clock signals SCCLKs and CRCLKs includes scan pulse output clock signals SCCLKs and carry pulse output clock signals CRCLKs.

Two gate driving signals Vgout(n) and Vgout(n+1) output from each GIP are used to sequentially drive the corresponding gate lines and the carry signal COUT(n) output from each GIP is used to reset a GIP of a previous stage or to set a GIP of a next stage.

In FIG. 2, an n-th GIP is set by the carry signal COUT (n−3) output from a third previous stage and is reset by the carry signal COUT(n+3) output from a third next stage. However, the present disclosure is not limited thereto and various methods such as a method of setting an n-th GIP by the carry signal COUT(n−4) output from an (n−4)-th previous stage and resetting the n-th GIP by the carry signal COUT(n+4) output from an (n+4)-th next stage may be used. As shown in FIG. 3, each GIP includes a node controller 100 set by the carry signal COUT output from the GIP of the previous stage and reset by the carry signal COUT output from the GIP of the next stage to control voltages of the first and second nodes Q and Qb, and an output unit 200 for receiving two of the plurality of scan pulse output clock signals SCCLKs and one of the plurality of carry pulse output clock signals CRCLKs and outputting at least two scan signals Vgout(n) and Vgout(n+1) and the carry signal COUT(n) according to the voltage levels of the first and second nodes Q and Qb.

Figure 4:
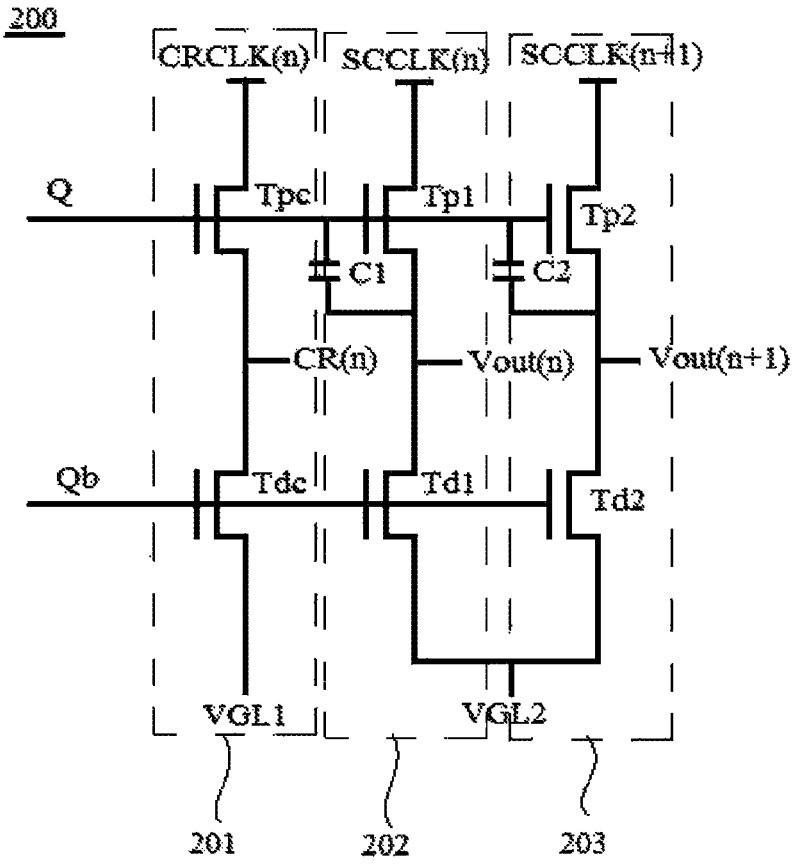
FIG. 4 is a circuit diagram of an output unit according to a first embodiment of the present disclosure.
Figure 5:
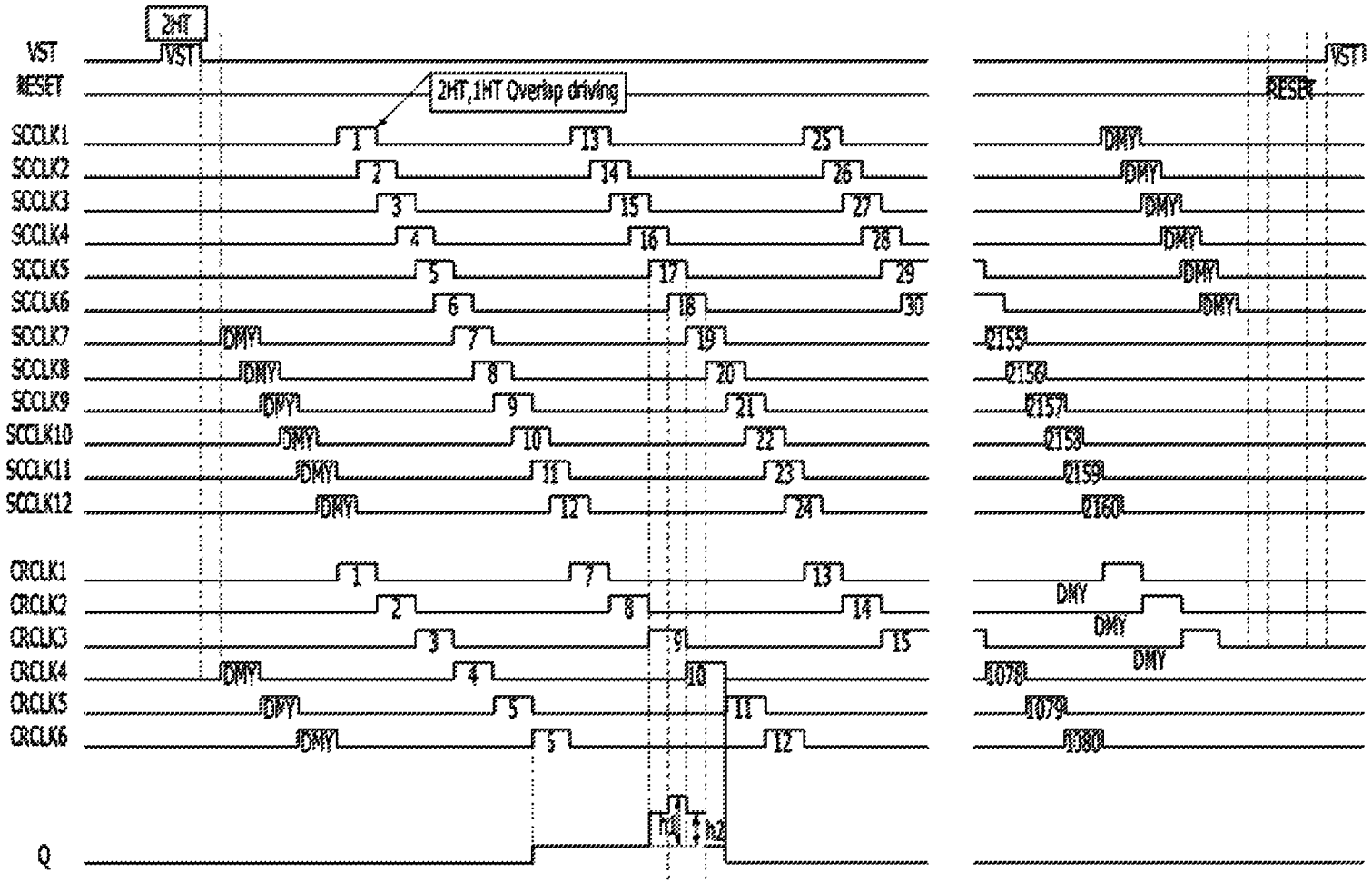
FIG. 5 is a waveform diagram of a plurality of clock signals SCCLKs and CRCLKs applied to the output unit according to the first embodiment of the present disclosure shown in FIG. 4 and the voltage of a first node Q.

FIG. 4 is a circuit diagram of the output unit 200 according to a first embodiment of the present disclosure, and FIG. 5 is a waveform diagram of the plurality of clock signals SCCLKs and CRCLKs applied to the output unit 200 and the voltage of a first node Q according to the first embodiment of the present disclosure shown in FIG. 4.

The output unit 200 of the GIP according to the first embodiment of the present disclosure includes a carry signal output unit 201, a first scan signal output unit 202 and a second scan signal output unit 203, as shown in FIG. 4.

The carry signal output unit 201 according to the first embodiment of the present disclosure includes a first pull-up transistor Tpc and a first pull-down transistor Tdc connected in series between a carry pulse output clock signal terminal CRCLK(n), to which one of the plurality of carry pulse output clock signal CRCLKs is applied, and a first gate low voltage terminal VGL1. The first pull-up transistor Tpc is turned on/off according to the voltage level of the first node Q and the first pull-down transistor Tdc is turned on/off according to the voltage level of the second node Qb, thereby outputting a carry signal CR(n).

The first scan signal output unit 202 according to the first embodiment of the present disclosure includes a second pull-up transistor Tp1, a second pull-down transistor Td1 and a first boosting capacitor C1. The second pull-up transistor Tp1 and the second pull-down transistor Td1 are connected in series between a scan pulse output clock signal terminal SCCLK(n), to which one of the plurality of scan pulse output clock signals SCCLKs is applied, and a second gate low voltage terminal VGL2. The first boosting capacitor C1 is connected between gate and source electrodes of the second pull-up transistor Tp1. The second pull-up transistor Tp1 is turned on/off according to the voltage level of the first node Q and the second pull-down transistor Td1 is turned on/off according to the voltage level of the second node Qb, thereby outputting a first scan signal Vout(n).

The second scan signal output unit 203 according to the first embodiment of the present disclosure includes a third pull-up transistor Tp2, and a third pull-down transistor Td2 and a second boosting capacitor C2. The third pull-up transistor Tp2 and the third pull-down transistor Td2 are connected in series between a scan pulse output clock signal terminal SCCLK(n+1), to which another of the plurality of scan pulse output clock signals SCCLKs is applied, and the second gate low voltage terminal VGL2. The second boosting capacitor C2 is connected between gate and source electrodes of the third pull-up transistor Tp2. The third pull-up transistor Tp2 is turned on/off according to the voltage level of the first node Q and the third pull-down transistor Td2 is turned on/off according to the voltage level of the second node Qb, thereby outputting a second scan signal Vout(n+1).

The channel width of the pull-up transistor Tpc of the carry signal output unit 201 is less than those of the pull-up transistors Tp1 and Tp2 of the first and second scan signal output units 202 and 203.

As shown in FIG. 5, the plurality of clock signals SCCLKs and CRCLKs according to the first embodiment of the present disclosure includes the scan pulse output clock signals SCCLKs and the carry pulse output clock signals CRCLKs.

The plurality of scan pulse output clock signals SCCLKs may include 12-phase clock signals shifted by a predetermined period, that is, first to twelfth clock signals SCCLK1 to SCCLK12. Each of the plurality of scan pulse output clock signals SCCLKs may have a high period during two horizontal periods (2HT) and adjacent scan pulse output clock signals SCCLKs overlap each other during one horizontal period (1HT).

The carry pulse output clock signals CRCLKs may include 6-phase clock signals shifted by a predetermined period, that is, first to sixth clock signals CRCLK1 to CRCLK6. Each of the plurality of carry pulse output clock signals CRCLKs may have a high period during two horizontal periods (2HT) and adjacent carry pulse output clock signals CRCLKs do not overlap each other.

In FIG. 5, a third carry pulse output clock signal CRCLK3 is applied to the carry pulse output clock signal terminal CRCLK(n) of the carry signal output unit 201 of the GIP shown in FIG. 4, a fifth scan pulse output clock signal SCCLK5 is applied to the scan pulse output clock signal terminal SCCLK(n) of the first scan signal output unit 202, and a sixth scan pulse output clock signal SCCLK6 is applied to the scan pulse output clock signal terminal SCCLK(n+1) of the second scan signal output unit 203.

In addition, in FIG. 5, the node controller 100 of the GIP(n) shown in FIG. 3 is set by the carry signal COUT (the carry signal output from GIP(n−3) for outputting the carry pulse by CRCLK6 because GIP(n) outputs the carry pulse by a third carry pulse output clock signal CRCLK3) output from a GIP GIP(n−3) of a third previous stage and is reset by the carry signal COUT (CRCLK5) output from a GIP GIP(n+2) of a second next stage, thereby controlling the voltages of the first and second nodes Q and Qb.

As described with reference to FIGS. 2 to 5, in the flat panel display device according to the first embodiment of the present disclosure, since one GIP drives two gate lines, even when the flat panel display device is implemented with high resolution, it is possible to realize a flat panel display device having a narrow bezel.

However, the output unit 200 of the GIP according to the first embodiment of the present disclosure uses a method of boosting the first node Q using the scan signal.

Accordingly, since the boosting capacitance of the carry signal output unit 201 is less than those of the first and second scan signal output units 202 and 203, influence on the first node Q is low and the first and second capacitors C1 and C2 formed in the first and second scan signal output units 202 and 203 function as holding capacitors. Therefore, a boosting level deviation (difference between h1 and h2) of the first node Q occurs over time. To this end, a deviation occurs in the rising and falling times of the scan signals output from the first and second scan signal output units 202 and 203, thereby causing a periodic luminance deviation in an image displayed on the flat panel display device.

Coupling between the outputs of the first and second scan signal output units 202 and 203 occurs to generate signal distortion. In addition, the voltage of the first node Q is partially decreased to decrease the gate-source voltage Vgs of each transistor of the output unit. Therefore, characteristics and reliability of the GIP may be reduced. Accordingly, in order to solve the above problems, another embodiment of the present disclosure will be provided.

Figure 6:
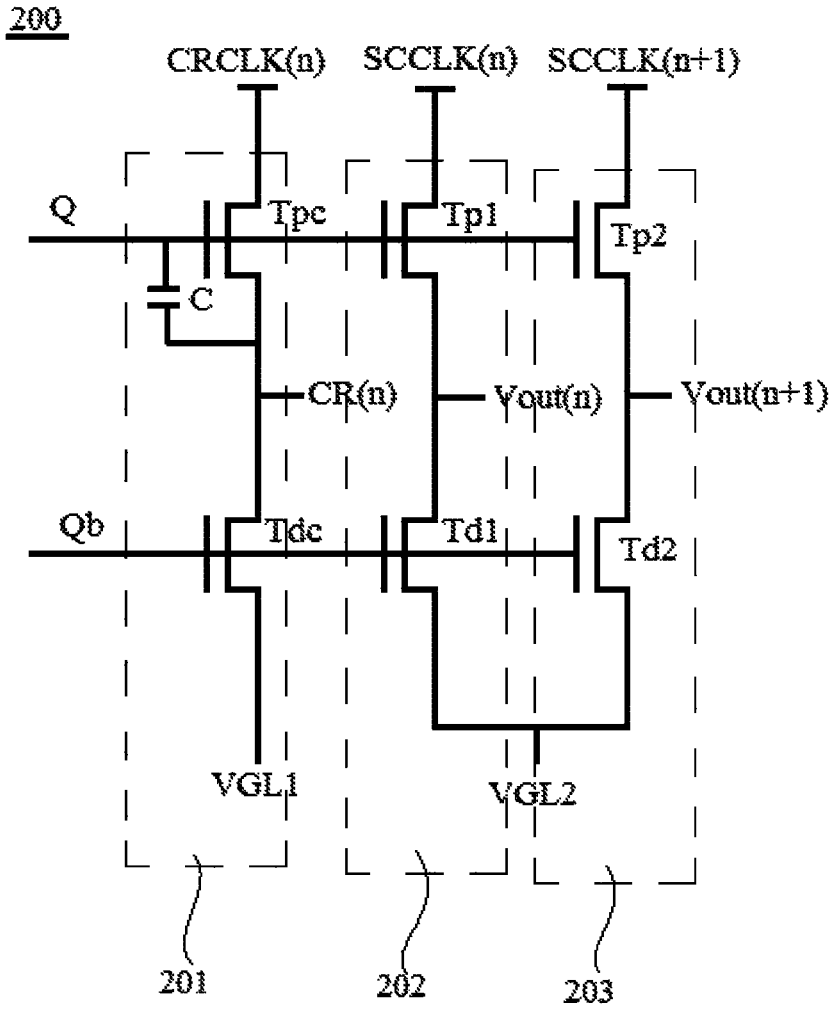
FIG. 6 is a circuit diagram of an output unit according to a second embodiment of the present disclosure.
Figure 7:
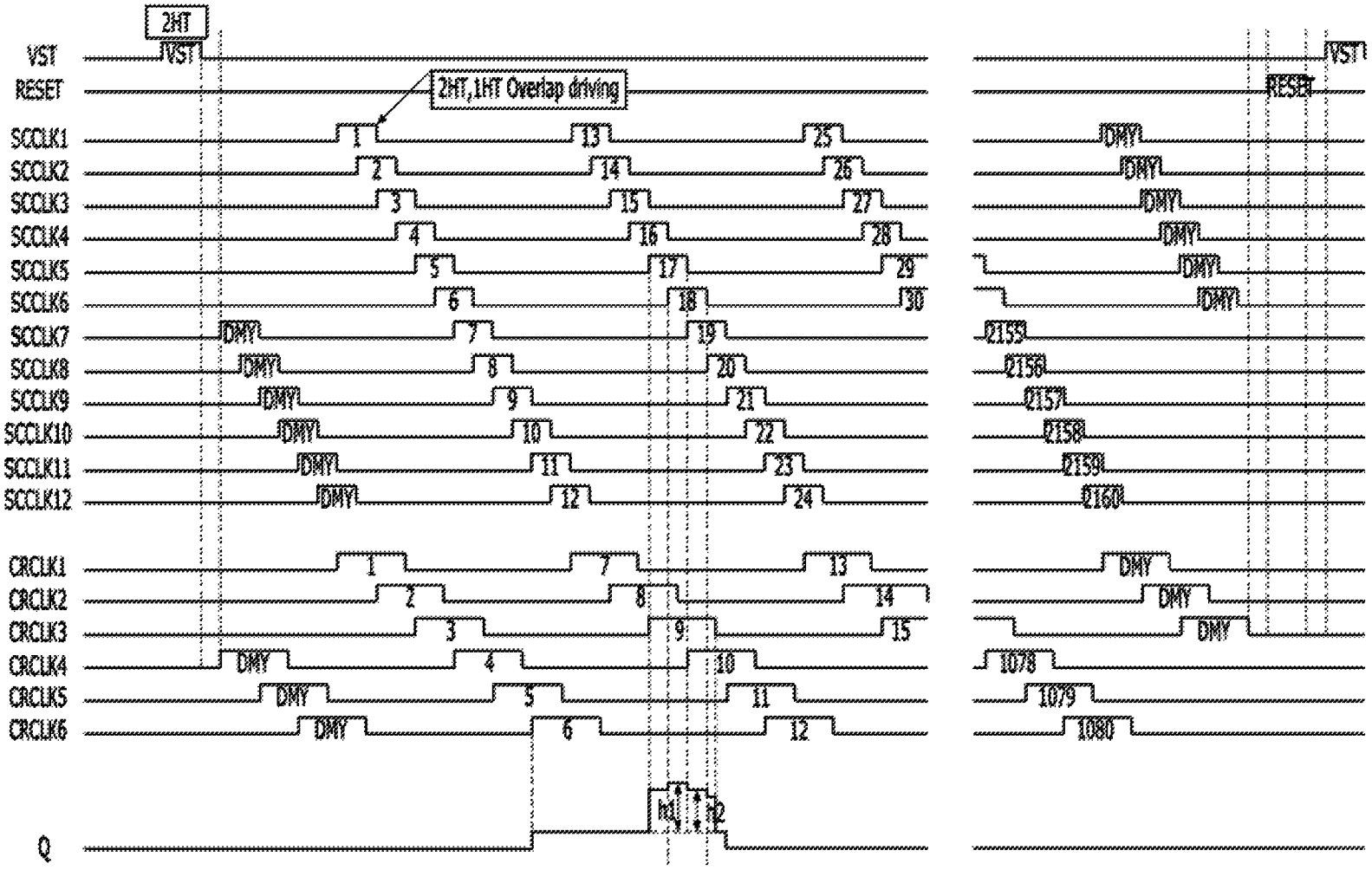
FIG. 7 is a waveform diagram of a plurality of clock signals SCCLKs and CRCLKs applied to the output unit according to the second embodiment of the present disclosure shown in FIG. 6 and the voltage of a first node Q.

FIG. 6 is a circuit diagram of an output unit 200 according to a second embodiment of the present disclosure, and FIG. 7 is a waveform diagram of a plurality of clock signals SCCLKs and CRCLKs applied to the output unit 200 according to the second embodiment of the present disclosure shown in FIG. 6 and the voltage of a first node Q.

The output unit 200 of the GIP according to the second embodiment of the present disclosure includes a carry signal output unit 201, a first scan signal output unit 202 and a second scan signal output unit 203, as shown in FIG. 6.

The carry signal output unit 201 according to the second embodiment of the present disclosure includes a first pull-up transistor Tpc, a first pull-down transistor Tdc and a boosting capacitor C. The first pull-up transistor Tpc and the first pull-down transistor Tdc are connected in series between a carry pulse output clock signal terminal CRCLK(n), to which one of the plurality of carry pulse output clock signals CRCLKs is applied, and a first gate low voltage terminal VGL1. The boosting capacitor C is connected between gate and source electrodes of the first pull-up transistor Tpc. The first pull-up transistor Tpc is turned on/off according to the voltage level of the first node Q and the first pull-down transistor Tdc is turned on/off according to the voltage level of the second node Qb, thereby outputting a carry signal CR(n).

The first scan signal output 202 according to the second embodiment of the present disclosure includes a second pull-up transistor Tp1 and a second pull-down transistor Td1 connected in series between a scan pulse output clock signal terminal SCCLK(n), to which one of the plurality of scan pulse output clock signals SCCLKs is applied, and a second gate low voltage terminal VGL2. The second pull-up transistor Tp1 is turned on/off according to the voltage level of the first node Q and the second pull-down transistor Td1 is turned on/off according to the voltage level of the second node Qb, thereby outputting a first scan signal Vout(n).

The second scan signal output unit 203 according to the second embodiment of the present disclosure includes a third pull-up transistor Tp2 and a third pull-down transistor Td2 connected in series between a scan pulse output clock signal terminal SCCLK(n+1), to which another of the plurality of scan pulse output clock signals SCCLKs is applied, and the second gate low voltage terminal VGL2. The third pull-up transistor Tp2 is turned on/off according to the voltage level of the first node Q and the third pull-down transistor Td2 is turned on/off according to the voltage level of the second node Qb, thereby outputting a second scan signal Vout(n+1).

As shown in FIG. 7, the plurality of clock signals SCCLKs and CRCLKs according to the second embodiment of the present disclosure includes the scan pulse output clock signals SCCLKs and the carry pulse output clock signals CRCLKs.

The plurality of scan pulse output clock signals SCCLKs may include 12-phase clock signals shifted by a predetermined period, that is, first to twelfth clock signals SCCLK1 to SCCLK12. Each of the plurality of scan pulse output clock signals SCCLKs may have a high period during two horizontal periods (2HT) and adjacent scan pulse output clock signals SCCLKs overlap each other during one horizontal period (1HT).

The carry pulse output clock signals CRCLKs may include 6-phase clock signals shifted by a predetermined period, that is, first to sixth clock signals CRCLK1 to CRCLK6. Each of the plurality of carry pulse output clock signals CRCLKs may have a high period during 3.5 horizontal periods (3.5H) and adjacent carry pulse output clock signals CRCLKs overlap each other during 1.5 horizontal periods (1.5H).

For convenience of description, each of the plurality of carry pulse output clock signals CRCLKs may have a high period during 3.5 horizontal periods (3.5H) and adjacent carry pulse output clock signals CRCLKs overlap each other during 1.5 horizontal periods (1.5H), on the assumption that each of the plurality of scan pulse output clock signals SCCLKs has a high period during two horizontal periods (2HT) and adjacent scan pulse output clock signals SCCLKs overlap each other during one horizontal period (1HT).

However, the present disclosure is not limited thereto and each of the plurality of carry pulse output clock signals CRCLKs may have a longer high period than the high period (3H) of two adjacent scan pulse output clock signals SCCLKs, and adjacent carry pulse output clock signals CRCLKs overlap each other during a period longer than one horizontal period (1HT).

In FIG. 7, a third carry pulse output clock signal CRCLK3 is applied to the carry pulse output clock signal terminal CRCLK(n) of the carry signal output unit 201 of the GIP shown in FIG. 6, a fifth scan pulse output clock signal SCCLK5 is applied to the scan pulse output clock signal terminal SCCLK(n) of the first scan signal output unit 202, and a sixth scan pulse output clock signal SCCLK6 is applied to the scan pulse output clock signal terminal SCCLK(n+1) of the second scan signal output unit 203.

In addition, in FIG. 7, the node controller 100 of the GIP(n) shown in FIG. 3 is set by the carry signal COUT (the carry signal output from GIP(n−3) for outputting the carry pulse by CRCLK6 because GIP(n) outputs the carry pulse by a third carry pulse output clock signal CRCLK3) output from a GIP GIP(n−3) of a third previous stage and is reset by the carry signal COUT (CRCLK6) output from a GIP GIP(n+3) of a third next stage, thereby controlling the voltages of the first and second nodes Q and Qb.

Although one carry signal output unit and two scan signal output units are included such that one GIP drives two gate lines in the first and second embodiments of the present disclosure, the present disclosure is not limited thereto and two or more scan signal output units may be included.

Figure 8:
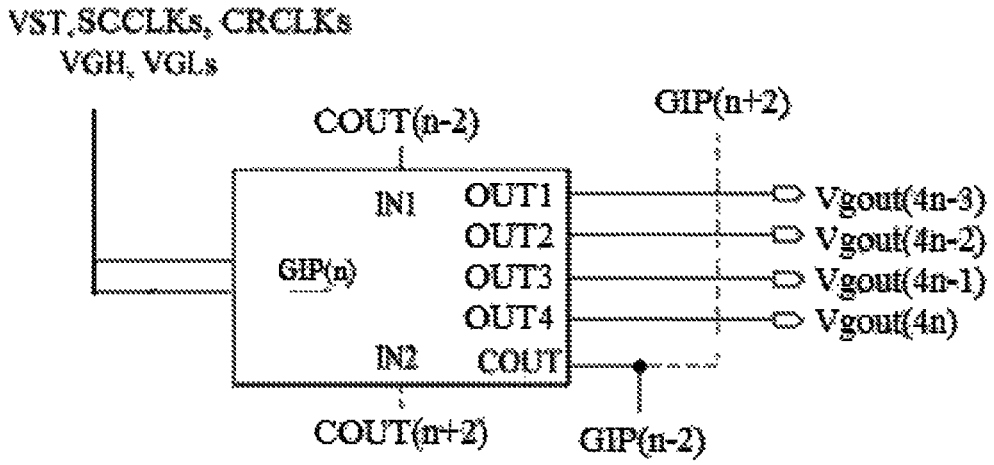
FIG. 8 is a diagram illustrating an n-th GIP in a gate driver according to another embodiment of the present disclosure.

FIG. 8 is a diagram illustrating an n-th GIP in a gate driver according to another embodiment of the present disclosure.

As described with reference to FIG. 2, the gate driver 2 according to the present disclosure includes the plurality of GIPs connected in cascade.

One GIP includes the output connected to four gate lines GL to sequentially generate four scan signals Vgout(4*n*−3), Vgout(4*n*−2), Vgout(4*n*−1) and Vgout(4*n*) and the carry signal COUT(n) according to the clock signals SCCLKs and CRCLKs received from the timing controller 4.

In FIG. 8, the n-th GIP(n) is set by the carry signal COUT(n−2) output from a second previous stage and is reset by the carry signal COUT(n+2) output from a second next stage. However, the present disclosure is not limited thereto.

Figure 9:
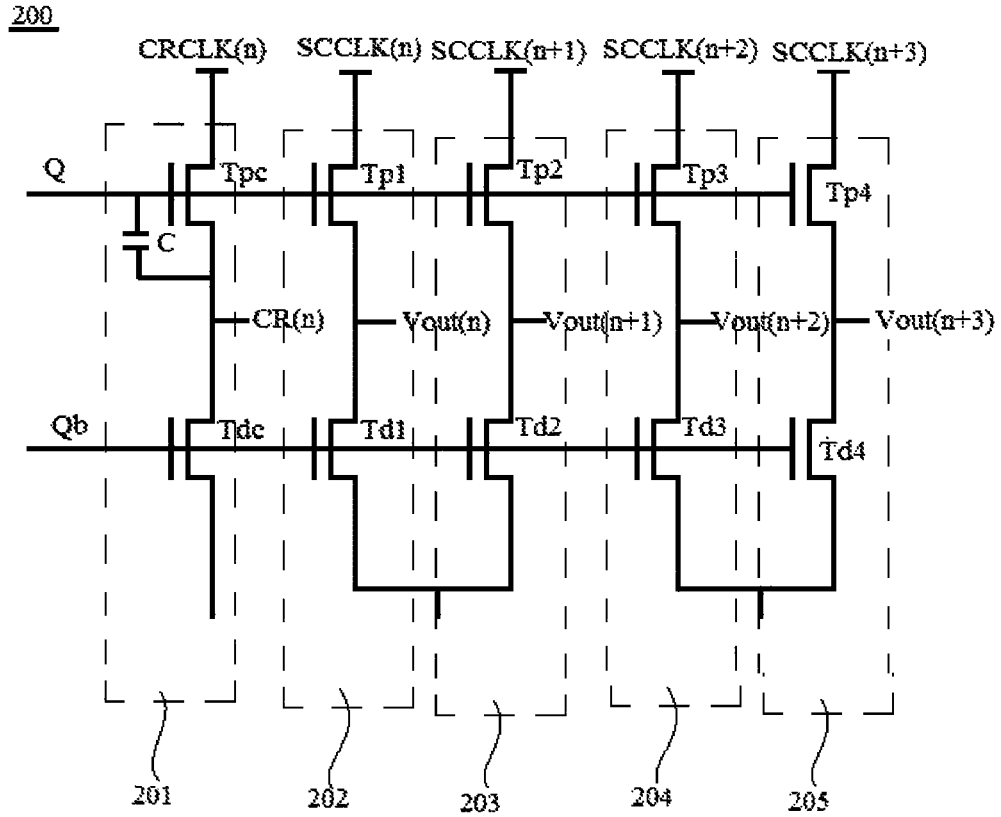
FIG. 9 is a circuit diagram of an output unit according to a third embodiment of the present disclosure.
Figure 10:
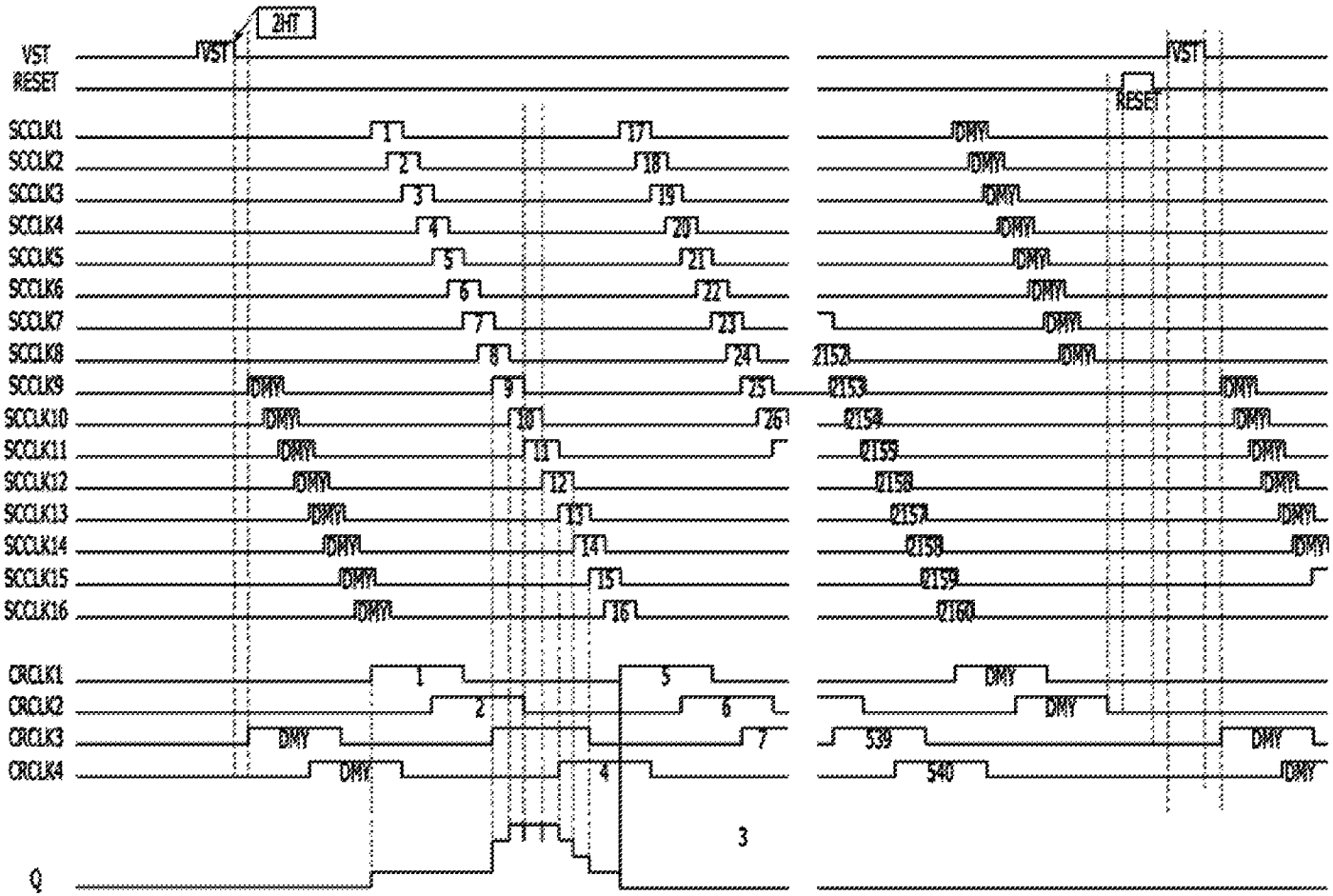
FIG. 10 is a waveform diagram of a plurality of clock signals SCCLKs and CRCLKs applied to the output unit shown in FIG. 9 and the voltage of a first node Q.

FIG. 9 is a circuit diagram of an output unit 200 according to a third embodiment of the present disclosure, and FIG. 10 is a waveform diagram of a plurality of clock signals SCCLKs and CRCLKs applied to the output unit 200 shown in FIG. 9 and the voltage of a first node Q.

The output unit 200 of the GIP according to the third embodiment of the present disclosure includes a carry signal output unit 201, a first scan signal output unit 202, a second scan signal output unit 203, a third scan signal output unit 204 and a fourth scan signal output unit 205, as shown in FIG. 9.

The carry signal output unit 201 according to the third embodiment of the present disclosure includes a first pull-up transistor Tpc, a first pull-down transistor Tdc and a boosting capacitor C. The first pull-up transistor Tpc and the first pull-down transistor Tdc are connected in series between a carry pulse output clock signal terminal CRCLK(n), to which one of the plurality of carry pulse output clock signals CRCLKs is applied, and a first gate low voltage terminal VGL1. The boosting capacitor C is connected between the gate and source electrodes of the first pull-up transistor Tpc. The first pull-up transistor Tpc is turned on/off according to the voltage level of the first node Q and the first pull-down transistor Tdc is turned on/off according to the voltage level of the second node Qb, thereby outputting a carry signal CR(n).

The first scan signal output unit 202 according to the third embodiment of the present disclosure includes a second pull-up transistor Tp1 and a second pull-down transistor Td1 connected in series between a scan pulse output clock signal terminal SCCLK(n), to which one of the plurality of scan pulse output clock signals SCCLKs is applied, and a second gate low voltage terminal VGL2. The second pull-up transistor Tp1 is turned on/off according to the voltage level of the first node Q and the second pull-down transistor Td1 is turned on/off according to the voltage level of the second node Qb, thereby outputting a first scan signal Vout(n).

The second scan signal output unit 203 according to the third embodiment of the present disclosure includes a third pull-up transistor Tp2 and a third pull-down transistor Td2 connected in series between a scan pulse output clock signal terminal SCCLK(n+1), to which another of the plurality of scan pulse output clock signals SCCLKs is applied, and the second gate low voltage terminal VGL2. The third pull-up transistor Tp2 is turned on/off according to the voltage level of the first node Q and the third pull-down transistor Td2 is turned on/off according to the voltage level of the second node Qb, thereby outputting a second scan signal Vout(n+1).

The third scan signal output unit 204 according to the third embodiment of the present disclosure includes a third pull-up transistor Tp3 and a third pull-down transistor Td3 connected in series between a scan pulse output clock signal terminal SCCLK(n+2), to which one of the plurality of scan pulse output clock signals SCCLKs is applied, and the second gate low voltage terminal VGL2. The third pull-up transistor Tp2 is turned on/off according to the voltage level of the first node Q and the third pull-down transistor Td2 is turned on/off according to the voltage level of the second node Qb, thereby outputting a third scan signal Vout(n+2).

The fourth scan signal output unit 205 according to the third embodiment of the present disclosure includes a fourth pull-up transistor Tp4 and a fourth pull-down transistor Td4 connected in series between a scan pulse output clock signal terminal SCCLK(n+3), to which another of the plurality of scan pulse output clock signals SCCLKs is applied, and the second gate low voltage terminal VGL2. The fourth pull-up transistor Tp3 is turned on/off according to the voltage level of the first node Q and the fourth pull-down transistor Td3 is turned on/off according to the voltage level of the second node Qb, thereby outputting a fourth scan signal Vout(n+3).

As shown in FIG. 10, the plurality of clock signals SCCLKs and CRCLKs according to the third embodiment of the present disclosure includes the scan pulse output clock signals SCCLKs and the carry pulse output clock signals CRCLKs.

The plurality of scan pulse output clock signals SCCLKs may include 16-phase clock signals shifted by a predetermined period, that is, first to sixteenth clock signals SCCLK1 to SCCLK16. Each of the plurality of scan pulse output clock signals SCCLKs may have a high period during two horizontal periods (2HT) and adjacent scan pulse output clock signals SCCLKs overlap each other during one horizontal period (1HT).

The carry pulse output clock signals CRCLKs may include 4-phase clock signals shifted by a predetermined period, that is, first to fourth clock signals CRCLK1 to CRCLK4. Each of the plurality of carry pulse output clock signals CRCLKs may have a high period during six horizontal periods (6H) and adjacent carry pulse output clock signals CRCLKs overlap each other during two horizontal periods (2HT).

For convenience of description, each of the plurality of carry pulse output clock signals CRCLKs may have a high period during six horizontal periods (6H) and adjacent carry pulse output clock signals CRCLKs overlap each other during two horizontal periods (2HT), on the assumption that each of the plurality of scan pulse output clock signals SCCLKs has a high period during two horizontal periods (2HT) and adjacent scan pulse output clock signals SCCLKs overlap each other during one horizontal period (1HT).

However, the present disclosure is not limited thereto and each of the plurality of carry pulse output clock signals CRCLKs may have a longer high period than the high period (5H) of four adjacent scan pulse output clock signals SCCLKs, and adjacent carry pulse output clock signals CRCLKs overlap each other during a period longer than one horizontal period (1HT).

In FIG. 10, a third carry pulse output clock signal CRCLK3 is applied to the carry pulse output clock signal terminal CRCLK(n) of the carry signal output unit 201 of the GIP shown in FIG. 9, a ninth scan pulse output clock signal SCCLK9 is applied to the scan pulse output clock signal terminal SCCLK(n) of the first scan signal output unit 202, a tenth scan pulse output clock signal SCCLK10 is applied to the scan pulse output clock signal terminal SCCLK(n+1) of the second scan signal output unit 203, an eleventh scan pulse output clock signal SCCLK11 is applied to the scan pulse output clock signal terminal SCCLK(n+2) of the third scan signal output unit 204, and a twelfth scan pulse output clock signal SCCLK12 is applied to the scan pulse output clock signal terminal SCCLK(n+3) of the fourth scan signal output unit 205.

In addition, in FIG. 10, the node controller 100 of the GIP(n) shown in FIG. 3 is set by the carry signal CRCLK1 output from a GIP GIP(n−2) of a second previous stage and is reset by the carry signal CRCLK1 output from a GIP GIP(n+2) of a second next stage, thereby controlling the voltages of the first and second nodes Q and Qb.

In the embodiments of the present disclosure, the number of scan pulse output clock signals SCCLKs, the number of carry pulse output clock signals CRCLKs and the waveform of each clock signal may be variously changed.

As described above, in the flat panel display devices according to the second and third embodiments of the present disclosure, since one GIP drives at least two gate lines, even when the flat panel display device is implemented with high resolution, it is possible to realize a flat panel display device having a narrow bezel and to solve the disadvantages of the first embodiment of the present disclosure.

FIG. 11A is a waveform diagram of the voltage of a first node Q and the carry signal output clock signal of the gate driver according to the first embodiment of the present disclosure and FIG. 11B is a waveform of the voltage of the first node Q and the carry signal output clock signal of a gate driver according to the second and third embodiments of the present disclosure.

FIG. 12A is an output waveform diagram of scan signals of the gate driver according to the first embodiment of the present disclosure, and FIG. 12B is an output waveform diagram of scan signals of the gate driver according to the second and third embodiments of the present disclosure.

As shown in FIG. 11A, the output unit 200 of the GIP according to the first embodiment of the present disclosure uses a method of boosting the first node Q using the scan signal and the scan pulse output clock signal SCCLK(n) and the carry pulse output clock signal CRCLK(n) have the same width.

Accordingly, since the output unit 200 of the GIP according to the first embodiment of the present disclosure uses a method of boosting the first node Q using the scan signal and the scan pulse output clock signal SCCLK(n) and the carry pulse output clock signal CRCLK(n) have the same width, a boosting level deviation (difference between h1 and h2) of the first node Q was about 14.8V.

Meanwhile, as shown in FIG. 11B, the output unit 200 of the GIP according to the second and third embodiments of the present disclosure uses a method of boosting the first node Q using the carry signal and the width of the carry pulse output clock signal CRCLK(n) is greater than that of the scan pulse output clock signal SCCLK(n).

Accordingly, since the output unit 200 of the GIP according to the second and third embodiments of the present disclosure uses a method of boosting the first node Q using the carry signal and the width of the carry pulse output clock signal CRCLK(n) is greater than that of the scan pulse output clock signal SCCLK(n), a boosting level deviation (difference between h1 and h2) of the first node Q was about 4.0V.

In comparison between FIGS. 11A and 11B, the output unit 200 of the GIP according to the second and third embodiments of the present disclosure can reduce the boosting level deviation (difference between h1 and h2) of the first node Q as compared to the output unit 200 according to the first embodiment of the present disclosure.

In addition, while the output unit 200 according to the first embodiment of the present disclosure uses the method of boosting the first node Q using the scan signal, the output unit 200 of the GIP according to the second and third embodiments of the present disclosure uses the method of boosting the first node Q using the carry signal. Accordingly, according to the second and third embodiments of the present disclosure, it is possible to reduce influence of the transistors of each scan signal output unit 202, 203, 204 or 205, as can be seen from comparison between FIGS. 12A and 12A.

As described above, since the output unit 200 of the GIP according to the second and third embodiments of the present disclosure can reduce influence of the transistors of the scan signal output units 202, 203, 204 and 205 and reduce the boosting level deviation (difference between h1 and h2) of the first node Q as compared to the output unit 200 of the GIP according to the first embodiment of the present disclosure, it is possible to reduce the deviation occurring in the rising and falling times of the scan signals output from the scan signal output units 202, 203, 204 and 205 and a periodic luminance deviation in the display displayed on the flat panel display panel.

In addition, since the output unit 200 of the GIP according to the second and third embodiments of the present disclosure sets the width of the carry pulse output clock signal CRCLK(n) to be greater than that of the scan pulse output clock signal SCCLK(n) to reduce the boosting level deviation (difference between h1 and h2) of the first node Q as compared to the output unit 200 of the GIP according to the first embodiment of the present disclosure, it is possible to maintain the boosting level of the first node Q at a high level while the scan pulse is output and to prevent characteristics and reliability of the GIP from being reduced due to decrease in gate-source voltage Vgs of each transistor of the output unit.

In addition, in the output unit 200 of the GIP according to the second and third embodiments of the present disclosure, since the boosting capacitor is installed only in the carry signal output unit and the boosting level deviation (difference between h1 and h2) of the first node Q is reduced, even when at least two scan signal output units are included, coupling between the scan signal output units does not occur, thereby preventing signal distortion.

That is, in the output unit 200 of the GIP according to the first embodiment of the present disclosure, as shown in FIG. 12A, signal distortion occurs between scan signals due to coupling between the scan signal output units.

However, in the output unit 200 of the GIP according to the second and third embodiments of the present disclosure, as shown in FIG. 12B, coupling between the scan signal output units does not occur and thus signal distortion does not occur between the scan signals.

In addition, in the output unit 200 of the GIP according to the second and third embodiments of the present disclosure, since the boosting capacitor C is installed only in the carry signal output unit 201, the capacity of the boosting capacitor is increased to secure the boosting level of the first node Q. Therefore, it is possible to secure output characteristics and positive bias temperature stress (PBTS) margin of the pull-up transistor of each output unit.

The gate driver and the flat panel display device according to the present disclosure having the above-described features have the following effects.

In the gate driver according to each embodiment of the present disclosure, since one GIP drives at least two gate lines, even when the flat panel display device is implemented with high resolution, it is possible to realize a flat panel display device having a narrow bezel.

The output unit of the GIP according to the second and third embodiments of the present disclosure uses the method of boosting the first node Q using the carry signal.

Accordingly, since the boosting capacitor is installed only in the carry signal output unit, it is possible to reduce influence of the transistor of each scan signal output unit and to reduce the boosting level deviation of the first node. Therefore, it is possible to reduce the deviation occurring in the rising and falling times of the scan signals output from each scan signal output unit and a periodic luminance deviation in the display displayed on the flat panel display panel.

Since the boosting level deviation of the first node is reduced and the width of the carry signal output clock signal is increased to maintain the boosting level of the first node at a high level while the scan pulse is output, it is possible to prevent characteristics and reliability of the GIP from being reduced due to decrease in gate-source voltage Vgs of each transistor of the output unit.

Even when at least two scan signal output units are provided, coupling between the scan signal output units does not occur, thereby preventing signal distortion.

Since the boosting capacitor is installed only in the carry signal output unit, the capacity of the boosting capacitor is increased, thereby securing the boosting level of the first node. Therefore, it is possible to secure output characteristics and positive bias temperature stress (PBTS) margin of the pull-up transistor of each output unit.

The present disclosure is not limited to the above-described embodiments and the accompanying drawings. Those skilled in the art will appreciate that various substitutions, modifications and variations are possible without departing from the technical scope and spirit of the disclosure.

What is claimed is:

1. A gate driver comprising:

a plurality of gate-in-panels (GIP) for sequentially supplying scan signals to a plurality of gate lines, wherein each GIP comprises a carry signal output unit and at least two scan signal output units to drive at least two gate lines, wherein the carry signal output unit comprises a pull-up transistor controlled by a voltage of a first node, a pull-down transistor controlled by a voltage of a second node, and a boosting capacitor formed between gate and source electrodes of the pull-up transistor, and wherein the carry signal output unit of an (N)th GIP receives a carry out signal from an (N−3)th GIP and a carry out signal from an (N+3)th GIP or the (N)th GIP receives a carry out signal from an (N−2)th GIP and a carry out signal from an (N+2)th GIP.

2. The gate driver according to claim 1, wherein one of a plurality of scan pulse output clock signals is applied to each of the at least two scan signal output units, wherein one of a plurality of carry pulse output clock signals is applied to the carry signal output unit, wherein the plurality of scan pulse output clock signals are shifted by a predetermined period, each scan pulse output clock signal has a high period during a predetermined horizontal period and adjacent scan pulse output clock signals overlap each other during a predetermined period, and wherein the plurality of carry pulse output clock signals are shifted by a predetermined period, each carry pulse output clock signal has a longer high period than a high period of two adjacent scan pulse output clock signals, and adjacent carry pulse output clock signals overlap each other during a period longer than one horizontal period.

3. The gate driver according to claim 1, wherein the at least two scan signal output units include a first scan signal output unit and a second scan signal output unit, wherein one of a plurality of scan pulse output clock signals is applied to the first scan signal output unit, wherein another of the plurality of scan pulse output clock signals is applied to the second scan signal output unit, wherein one of a plurality of carry pulse output clock signals is applied to the carry signal output unit, wherein the plurality of scan pulse output clock signals are shifted by a predetermined period, each scan pulse output clock signal has a high period during a predetermined period and adjacent scan pulse output clock signals overlap each other during a predetermined period, and wherein the plurality of carry pulse output clock signals are shifted by a predetermined period, each carry pulse output clock signal has a longer high period than a high period of two adjacent scan pulse output clock signals, and adjacent carry pulse output clock signals overlap each other during a period longer than one horizontal period.

4. The gate driver according to claim 3, wherein each scan pulse output clock signal has a high period during two horizontal periods and adjacent scan pulse output clock signals overlap each other during one horizontal period, and wherein each carry pulse output clock signal has a high period during 3.5 horizontal periods and adjacent carry pulse output clock signals overlap each other during 1.5 horizontal periods.

5. The gate driver according to claim 1, wherein the at least two scan signal output units include a first scan signal output unit, a second scan signal output unit, a third scan signal output unit, and a fourth scan signal output unit to drive four gate lines.

6. The gate driver according to claim 5, wherein one of a plurality of scan pulse output clock signals is applied to each of the first scan signal output unit, the second scan signal output unit, the third scan signal output unit, and the fourth scan signal output unit, wherein one of a plurality of carry pulse output clock signals is applied to the carry signal output unit, wherein the plurality of scan pulse output clock signals are shifted by a predetermined period, each scan pulse output clock signal has a high period during a predetermined horizontal period and adjacent scan pulse output clock signals overlap each other during a predetermined period, and wherein the plurality of carry pulse output clock signals are shifted by a predetermined period, each carry pulse output clock signal has a longer high period than a high period of four adjacent scan pulse output clock signals, and adjacent carry pulse output clock signals overlap each other during a period longer than one horizontal period.

7. The gate driver according to claim 6, wherein each scan pulse output clock signal has a high period during two horizontal periods and adjacent scan pulse output clock signals overlap each other during one horizontal period, and wherein each carry pulse output clock signal has a high period during six horizontal periods and adjacent carry pulse output clock signals overlap each other during two horizontal periods.

8. A flat panel display device comprising:

a display panel including a plurality of gate lines and a plurality of data lines and a plurality of subpixels formed in a matrix to supply data voltages to the plurality of data lines in response to scan pulses supplied to the plurality of gate lines to display an image;

a gate driver for sequentially supplying the scan pulses to the plurality of gate lines;

a data driver for supplying the data voltages to the plurality of data lines; and a timing controller for aligning image data received from outside of the timing controller according to a size and resolution of the display panel to supply the image data to the data driver and respectively supplying a plurality of gate control signals and a plurality of data control signals to the gate driver and the data driver using synchronization signals received from the outside of the timing controller, wherein the gate driver comprises a plurality of gate-in-panels GIP for sequentially supplying scan signals to the plurality of gate lines, wherein each GIP comprises one carry signal output unit and at least two scan signal output units to drive at least two gate lines, wherein the carry signal output unit comprises a pull-up transistor controlled by a voltage of a first node, a pull-down transistor controlled by a voltage of a second node, and a boosting capacitor formed between gate and source electrodes of the pull-up transistor, and wherein the carry signal output unit of an (N)th GIP receives a carry out signal from an (N−3)th GIP and a carry out signal from an (N+3)th GIP or the (N)th GIP receives a carry out signal from an (N−2)th GIP and a carry out signal from an (N+2)th GIP.

9. The flat panel display device according to claim 8, wherein the at least two scan signal output units includes a first scan signal output unit and a second scan signal output unit to drive two gate lines, wherein one of a plurality of scan pulse output clock signals is applied to the first scan signal output unit, wherein another of the plurality of scan pulse output clock signals is applied to the second scan signal output unit, wherein one of a plurality of carry pulse output clock signals is applied to the carry signal output unit, wherein the plurality of scan pulse output clock signals are shifted by a predetermined period, each scan pulse output clock signal has a high period during a predetermined period and adjacent scan pulse output clock signals overlap each other during a predetermined period, wherein the plurality of carry pulse output clock signals are shifted by a predetermined period, each carry pulse output clock signal has a longer high period than a high period of two adjacent scan pulse output clock signals, and adjacent carry pulse output clock signals overlap each other during a period longer than one horizontal period.

10. The flat panel display device according to claim 8, wherein the at least two scan signal output units comprise a first scan signal output unit, a second scan signal output unit, a third scan signal output unit, and a fourth scan signal output unit to drive four gate lines and one of a plurality of scan pulse output clock signals is applied to each of the first scan signal output unit, the second scan signal output unit, the third scan signal output unit, and the fourth scan signal output unit, wherein one of a plurality of carry pulse output clock signals is applied to the carry signal output unit, wherein the plurality of scan pulse output clock signals are shifted by a predetermined period, each scan pulse output clock signal has a high period during a predetermined horizontal period and adjacent scan pulse output clock signals overlap each other during a predetermined period, and wherein the plurality of carry pulse output clock signals are shifted by a predetermined period, each carry pulse output clock signal has a longer high period than a high period of four adjacent scan pulse output clock signals, and adjacent carry pulse output clock signals overlap each other during a period longer than one horizontal period.

* * * * *